US005344150A

United States Patent [19]

Schmidt et al.

[11] Patent Number: 5,344,150

[45] Date of Patent: Sep. 6, 1994

[54] IRON GOLF CLUB HEAD WITH STRAIGHT, HORIZONTAL RECESS

[75] Inventors: Glenn Schmidt, Malibu; Richard C. Helmstetter, Carlsbad, both of Calif.

[73] Assignee: Callaway Golf Company, Carlsbad, Calif.

[21] Appl. No.: 999,251

[22] Filed: Jan. 19, 1993

Related U.S. Application Data

[63] Continuation-in-part of Ser. No. 921,857, Aug. 5, 1992, Pat. No. 5,282,625.

[51] Int. Cl.[5] ..... A63B 53/04

[52] U.S. Cl. ..... 273/167 H; 273/169; 273/167 F

[58] Field of Search ..... 273/167 R, 167 B, 167 D, 273/167 E, 167 F, 167 G, 167 H, 167 J, 167 K, 169, 78, 172, 175

[56] References Cited

U.S. PATENT DOCUMENTS

| | | | |
|---|---|---|---|
| D. 228,355 | 9/1973 | Penna . | |
| D. 234,963 | 4/1975 | Kirata . | |
| D. 303,132 | 8/1989 | Muta . | |
| D. 321,920 | 11/1991 | Parente et al. . | |
| 1,854,548 | 4/1932 | Hunt . | |
| 1,993,928 | 3/1935 | Glover . | |
| 2,231,847 | 2/1941 | Dickson et al. . | |
| 3,068,011 | 12/1962 | Sano . | |
| 3,199,872 | 8/1965 | Taylor . | |
| 3,847,399 | 11/1974 | Raymont . | |
| 4,398,965 | 8/1983 | Campau . | |
| 4,632,400 | 12/1986 | Boone . | |
| 4,653,756 | 3/1987 | Sato | 273/169 |
| 4,798,383 | 1/1989 | Nagasaki et al. | 273/167 H |
| 4,848,747 | 7/1989 | Fujimura et al. . | |
| 4,854,581 | 8/1989 | Long . | |
| 4,884,812 | 12/1989 | Nagasaki et al. . | |
| 4,913,435 | 4/1990 | Kobayashi . | |
| 4,928,972 | 5/1990 | Nakanishi et al. . | |
| 4,957,294 | 9/1990 | Long . | |
| 4,964,640 | 10/1990 | Nakanishi et al. . | |
| 4,986,541 | 1/1991 | Teramoto et al. . | |
| 4,995,609 | 2/1991 | Parente et al. . | |
| 5,016,882 | 5/1991 | Fujimura et al. | 273/169 |
| 5,046,733 | 9/1991 | Antonious | 273/169 |
| 5,067,711 | 11/1992 | Parente et al. . | |

FOREIGN PATENT DOCUMENTS 371974 3/1932 United Kingdom .

OTHER PUBLICATIONS

"Some of Our Best Friends are Hookers and Pushers", Golf World, Jan. 1974, p. 45.

"The Ounce That Counts", Golf World, Jan. 24, 1975, pp. 46 & 47.

"Stroke-Savers," Golf Digest, Mar. 1988, pp. 82 & 83.

"FTD Iron by First Flight", Golf World, May 23, 1972, p. 10.

"The Wilson Staff Dynapower iron", Time Magazine, Mar. 24, 1967, p. 1.

"T.P. Super Blade", Golf World, Jun. 13, 1972, p. 25.

*Primary Examiner*—Vincent Millin

*Assistant Examiner*—Steven B. Wong

*Attorney, Agent, or Firm*—William W. Haefliger

[57] ABSTRACT

A golf club head having a body defining a heel, toe, top wall, sole, and a front wall defining an upwardly and rearwardly inclined front face in ball-addressing position of the head, and comprising a) said body defining a forwardly extending main recess located rearwardly of said front wall, b) and said body having upper and lower projections extending rearwardly from said front wall above and below said main recess, said projections being rearwardly elongated and said recess being horizontally elongated in said ball-addressing position of the head.

18 Claims, 8 Drawing Sheets

19
2
14
60a
11
24a
24
60
13
62
18
26a
26
101
62a
3
~17a~
3
63a
61a
12
27
27a
63
61
15
100
25a
10
25
2

24aa
24b
24
19
10
24a
18

17
~21~
16
25aa
25a
12
25b
25

10
18
19
17
16
17a
27a
26
13
~21~
26a
12
27
24a
24
26aa
27aa

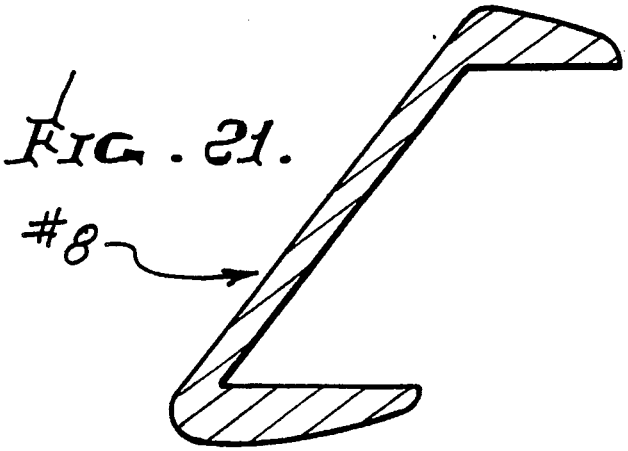
FIG. 21.
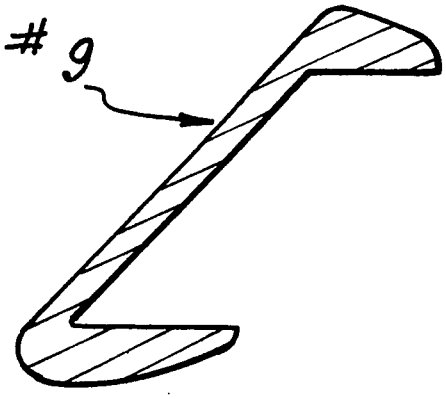
FIG. 22.
FIG. 23.
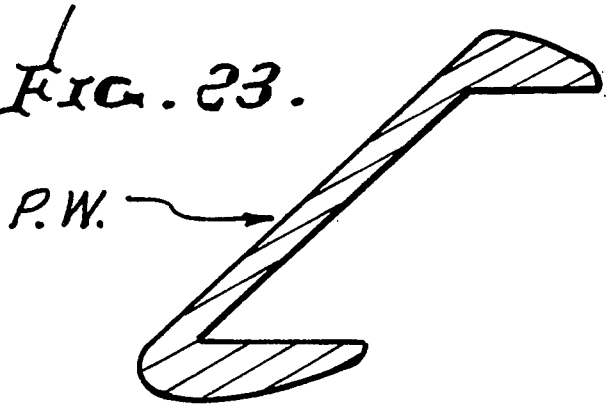

IRON GOLF CLUB HEAD WITH STRAIGHT, HORIZONTAL RECESS

This application is a continuation-in-part of Ser. No. 921,857 filed Aug. 5, 1992.

BACKGROUND OF THE INVENTION

This invention relates generally to golf clubs, and more particularly to golf club irons of improved construction to achieve advantages, such as twist resistance, during impact with golf balls, and delayed momentum transfer to golf balls during stroking. In this regard, and in the past, irons evolved in design from flat back to hollow back structure, the present invention providing a further evolution in back structure to achieve virtual head enlargement effects.

Many efforts have been made to design iron heads to achieve higher energy availability for transfer to the golf ball when the ball is impacted by the head. However, no way was known, to our knowledge, to achieve twist resistance and delayed momentum transfer to the ball, over the very short time interval when the ball remains in contact with the head face, in the novel and unusual manner as achieved by the present invention; and no way was known to couple such twist resistance with delayed energy transfer, in the manner to be described.

SUMMARY OF THE INVENTION

It is a major object of the invention to provide an improved iron head construction meeting the need for delayed momentum transfer to the ball during club stroking, and also to provide club head increased twist resistance. Basically, the invention as embodied in a head metallic body, provides a main rearwardly extending recess that is horizontally elongated, and bounded by head metallic extents projecting rearwardly from peripheral regions of the head face defining front wall. For example, the head includes:

a) a body defining a forwardly extending main recess located rearwardly of the front wall, b) and the body having upper and lower projections extending rearwardly from the front wall above and below the main recess, the projections being rearwardly elongated and the recess being horizontally elongated in the ball-addressing position of the head.

It is another object to provide an iron golf club head wherein the upper rearward projection has a lower surface and the lower projection has an upper surface, a vertical plane normal to the front face intersecting those surfaces to define lines that extend horizontally rearwardly in the ball-addressing position. Typically, the lower surface is upwardly concave along its length in a direction between the heel and toe.

Yet another object is the provision of a third rearward projection at the toe and which is rearwardly elongated adjacent the rearwardly horizontally elongated recess. That third projection, for example, may have an inner surface characterized in that horizontal planes intersect the inner surface to define lines that extend horizontally rearwardly in the ball-addressing position.

An additional object is the provision of a club head in which one or more, and typically all, of such rearward projections taper rearwardly, with the inner surfaces extending horizontally and the projection outer surfaces tapering rearwardly. In this 2regard, each of the rearwardly elongated projections has an overall rearward length dimension and a thickness dimension outwardly from the recess, the length dimension substantially exceeding the thickness dimension.

A further object is the provision of a head, as described, wherein the third projection arcuately merges with each of the upper and lower projections to define two arcuate and rearwardly extending corner projections, each of which has an inner corner surface facing the recess, the inner corner surface projecting horizontally rearwardly in the ball-addressing position.

Yet another object is the provision of a head, as described, wherein the body has at least one slit extending rearwardly in at least one of the projections and outwardly from the main recess. Multiple of such slits are typically provided in multiple of the rearwardly elongated projections.

Yet another object is to provide a set of irons, each iron incorporating the rearwardly horizontally elongated recess, as referred to, and the bounding rearward projections extending generally horizontally, irrespective of the angles of the front faces of the irons in the set.

These and other objects and advantages of the invention, as well as the details of illustrative embodiments, will be more fully understood from the following specification and drawings, in which:

DRAWING DESCRIPTION

FIGS. 15–22 are sections like FIG. 8 but showing a sequence of head cross sections from a #2 iron to a #9 iron; and FIG. 23 is a section like FIG. 22 but showing a pitching wedge cross section.

DETAILED DESCRIPTION

Figure 1:
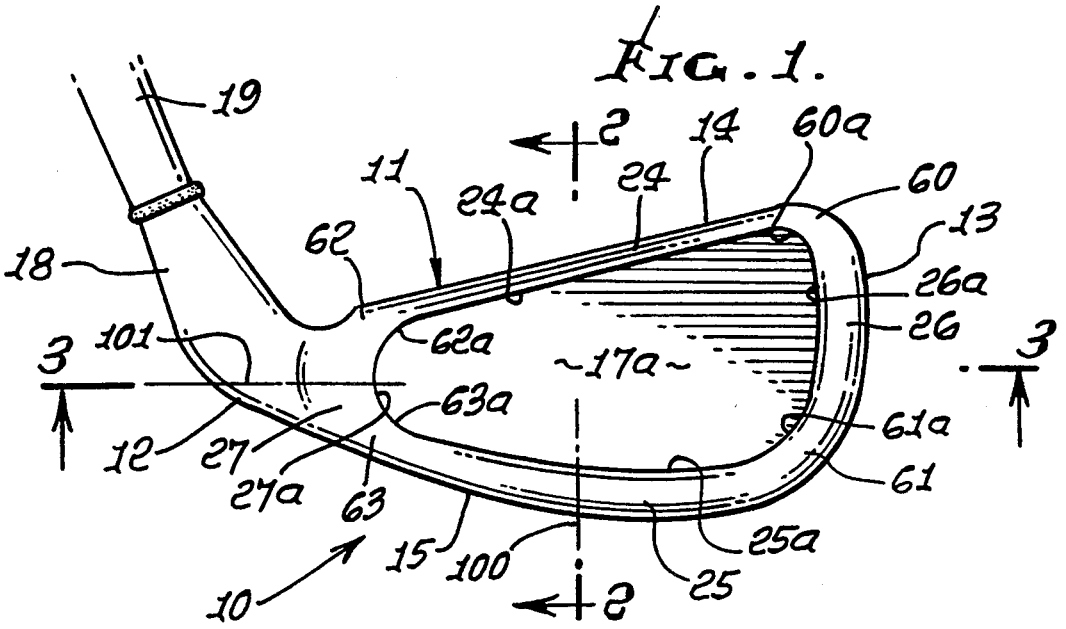
FIG. 1 is a frontal elevation of a #1 iron of a golf club set incorporating the invention.

Referring first to FIG. 1, the illustrated golf club head 10, in the form of a #1 iron of a set has a body 11 defining a heel 12, toe 13, top wall 14, and sole 15. The body also defines an upwardly and rearwardly inclined front face 16 at the frontal side of an associated front wall 17. A hosel is shown at 18 and integrally joins the body; and a shaft 19 extends into and through the hosel as shown, and is anchored therein in a suitable manner. The head and hosel may consist of a one-piece, metallic, steel casting, other metals and alloys being usable. Face 16 may be formed by a graphite or other non-metallic insert.

In accordance with one aspect of the invention, the body defines a rearwardly extending recess bounded by elongated body projections, the recess extending horizontally rearwardly in ball-addressing position of the head, irrespective of the head front face angularity, i.e., for all clubs in a set.

Figure 2:
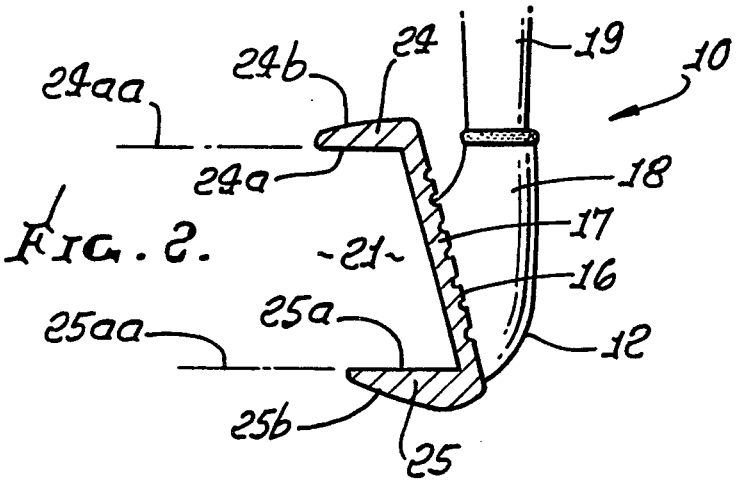
FIG. 2 is a section taken on lines 2—2 of FIG. 1.
Figure 3:
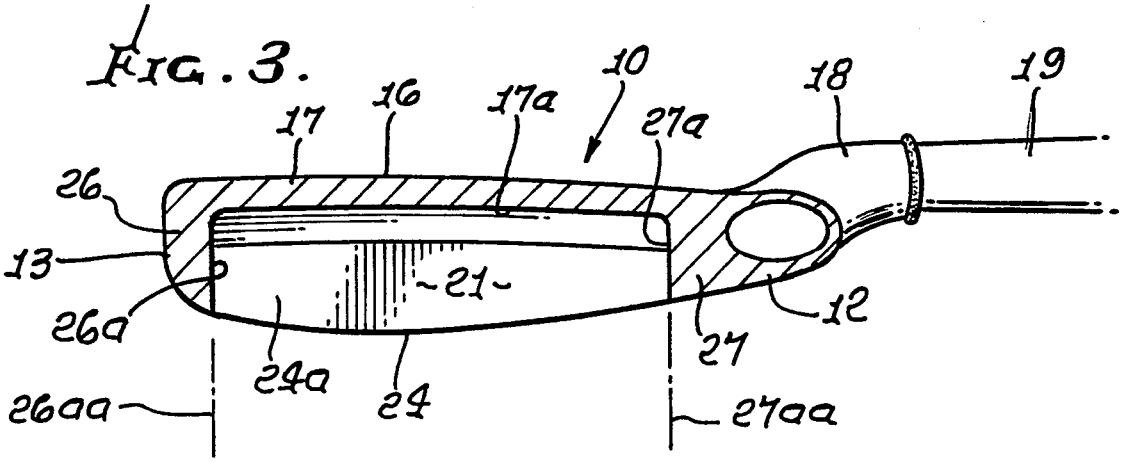
FIG. 3 is a horizontal section on lines 3—3 of FIG. 1.

In FIGS. 1–3, the main recess 21 extends horizontally forwardly to the rear side 17*a* of wall 17, and horizontally rearwardly to open at the rear side of the head, as shown. The recess is bounded by rearward projections, including upper and lower projections 24 and 25 extending rearwardly from the front wall, above and below the recess 21. The projections are rearwardly elongated, as is the recess 21. The upper projection 24 has a lower surface 24*a* characterized in that vertical planes 100, i.e., FIG. 2 being representative of one such plane, which extend normal to the front face 16, intersect the surface 24*a* to define horizontally rearwardly extending lines, (see line 24*aa*) along the length of the surface 24*a*, in a heel-to-toe direction. Also, surface 24*a* is typically inclined, as in FIG. 1. Similarly, the lower projection 25 has an upper surface 25*a* characterized in that vertical planes 100 intersect the surface 25*a* to define horizontally rearwardly extending lines, (see line 25*aa*) along the length of the surface 25*a* in a heel-to-toe direction. Also, surface 25*a* typically is upwardly concave, along its length, as shown in FIG. 1.

These constructional features provide benefits that include metal redistribution toward the upper and lower peripheries of the head, and projecting rearwardly at 24 and 25, for enhancing anti-twist of the head during stroking and ball impact. Such metal rearwardly redistribution, i.e., lengthening in a rearwardly and functionally outwardly (enlarging effect) direction, as at 24 and 25, is believed to achieve somewhat delayed momentum transfer from the rearwardly elongated metal projections 24 and 25, to the front wall and front face 16, since such momentum is transferred to only the uppermost and lowermost projections of the front wall due to the horizontal surface characteristics of 24*a* and 25*a*, thereby maintaining a greater time interval of front face contact with the ball during stroking, for better ball control.

Note that such momentum transfer, visualized in the form of forward waves, is required to pass from elongated projections 24 and 25 around and through the uppermost and lowermost extents of the front wall 17 enhancing such delay. Enhanced performance and ball control have been determined by repeated, actual use of such an iron, both with humans and robots.

The head body also has a third rearward projection at the toe and which is rearwardly elongated adjacent the rearwardly horizontally elongated recess. The third projection 26, as seen in FIG. 3, has an inner surface 26*a* which faces the recess 21, and is characterized in that horizontal planes 101 (i.e., the plane of FIG. 3, for example) intersect the inner surface to define lines that extend horizontally rearwardly in ball address position. See line These characteristics of 26 and 26*a* enhance the beneficial effects referred to above, such momentum transfer from 26 to the first wall 17 being required to pass around and through the outermost toe extent of the front wall.

The projections 24–26 each taper rearwardly, as for example is shown, i.e., their outer surfaces 24*b*–26*b* taper toward the planes defined by inner surfaces 24*a*–26*a*, and toward the horizontally extending lines associated therewith, as defined above.

Note also that rearward projections 24, 25, and 26 are rearwardly elongated in relation to their thickness dimensions showing that metal has been redistributed to those projections to enhance the effects described and without increasing the overall vertical dimension of the head. Also, each of the rearward projections has an overall rearward length dimension and a thickness dimension outwardly from the recess, the length dimension substantially exceeding the thickness dimension.

The body also has a fourth rearward projection 27, defining an inner surface 27*a* facing recess 21, and closer to the heel 12 than recess boundary surface 24*a*–26*a*. Horizontal planes, as for example the plane of FIG. 3, intersect surface 27*a* at lines that extend horizontally rearwardly, in ball address position of the head. See line 27*aa*. This constructions contributes to the benefits in construction, functions and results, as referred to above.

The third projection 26 arcuately merges with each of the projections 24 and 25 to define two arcuate corner projections 60 and 61, which project rearwardly. They have inner corner surfaces 60*a* and 61*a* which project horizontally rearwardly in ball address position. Similar corner projections 62 and 63 merge with the ends of projections 24 and 25 closest to the heel, and with projection 27, and have inner corner surfaces 62*a* and 63*a* which project horizontally rearwardly in ball address position.

The inner sides 24*a*–27*a* and 60*a*–63*a* of the projections 24–27, and of the corners, are substantially flat in a forward to rearward direction; however, they define a loop subtending the major areal extent of the front face, including a "sweet spot" proximate the center of the latter.

Figure 13:
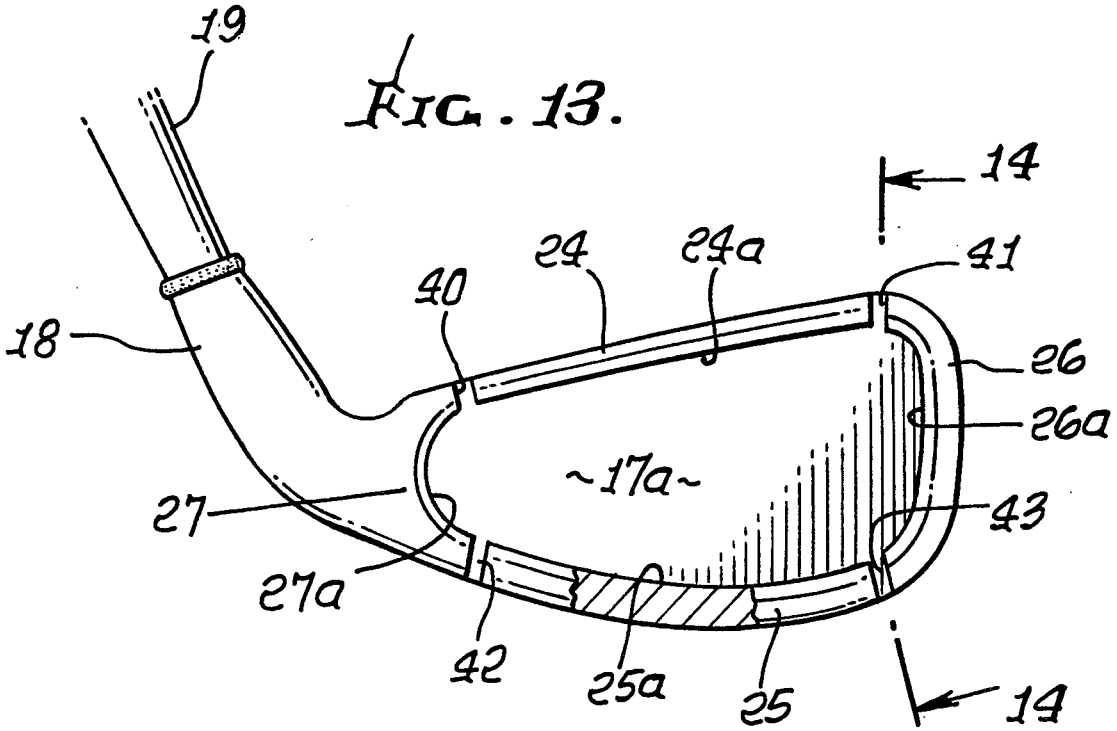
FIG. 13 is a rear view of a head, like that of FIGS. 1–3, but showing slots extending rearwardly from the undercut recess at different positions along the looping length of that recess.
Figure 14:
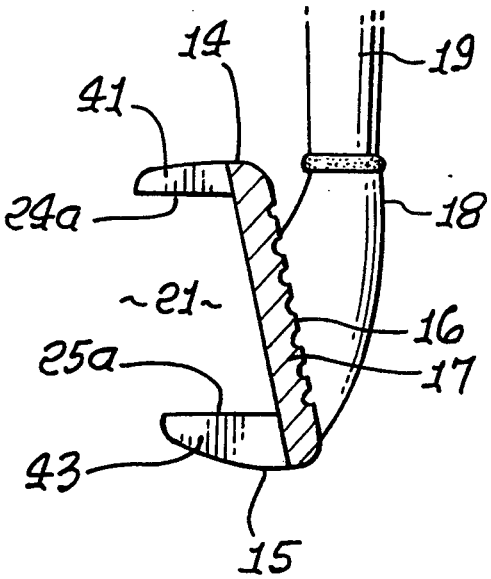
FIG. 14 is a section taken on lines 14—14 of FIG. 13.

FIG. 13 shows that slots may be provided, as at 40–43, proximate corners of the loop defined by the rearward projections 24–27 to decouple or reduce the stiffening effect of joining the rearward extending projections 24–27 at the loop corners. This allows the momentum transfer from each of such projections to proceed forwardly with delayed action, as referred to without being affected by the momentum transfer associated with the other projections, or attenuated by the effects of such other projections.

Figure 4:
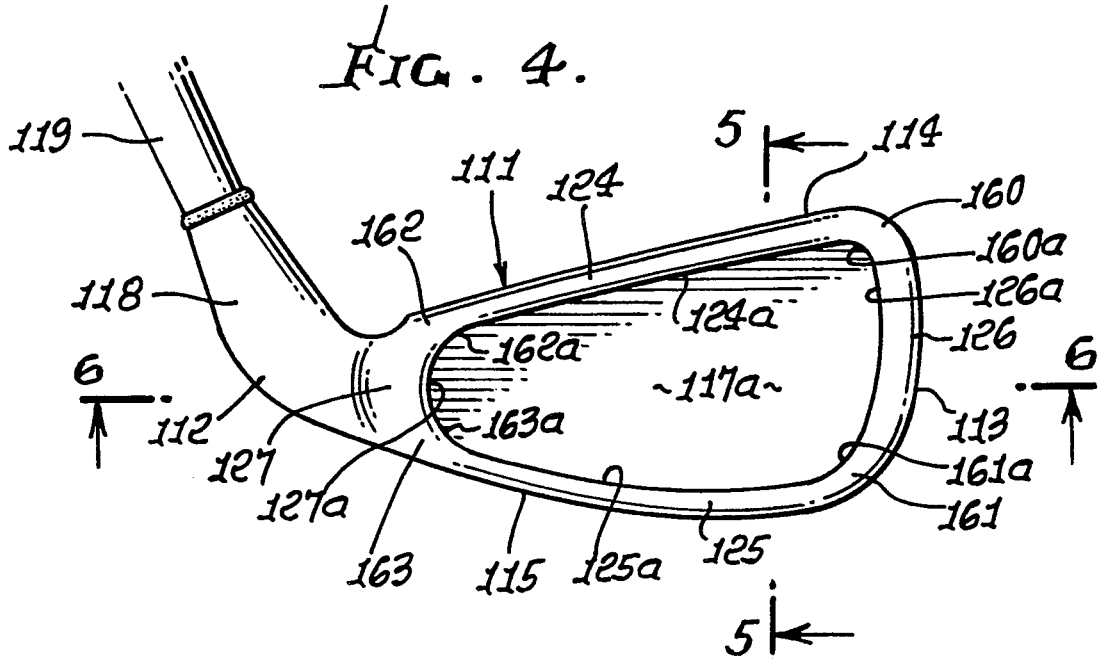
FIG. 4 is a view like FIG. 1 but showing a #6 iron incorporating the invention.
Figure 5:
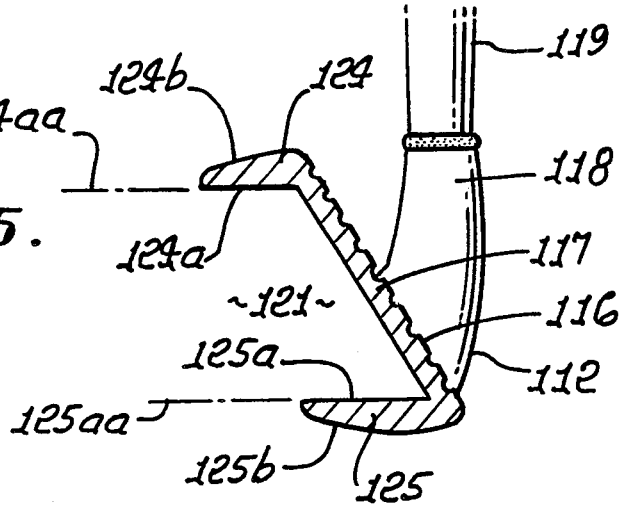
FIG. 5 is a section taken on lines 5—5 of FIG. 1.
Figure 6:
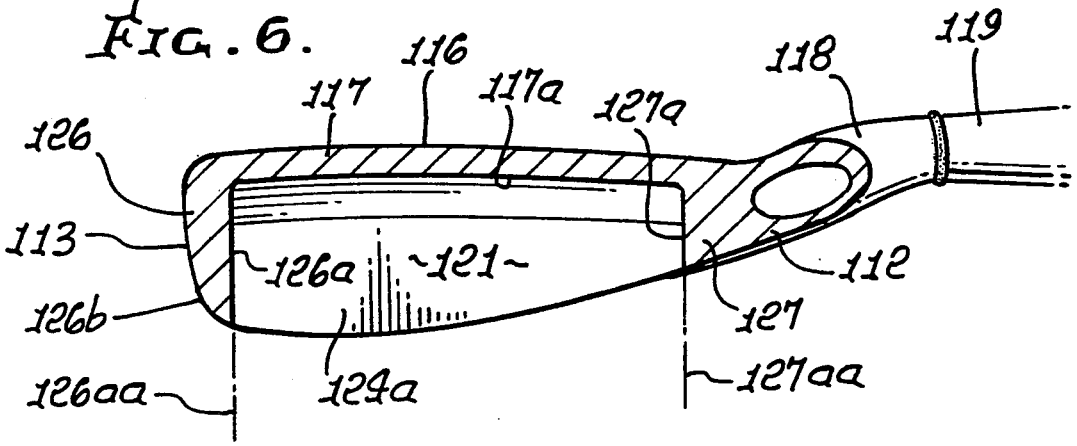
FIG. 6 is a horizontal section on lines 6—6 of FIG. 4.

FIGS. 4–6 show a corresponding construction of a #6 iron, having a more inclined front face, as shown. The corresponding numbered elements are the same as those in FIGS. 1–3, with each number preceded by a 1, i.e., providing a one hundred series of numbers.

Figure 7:
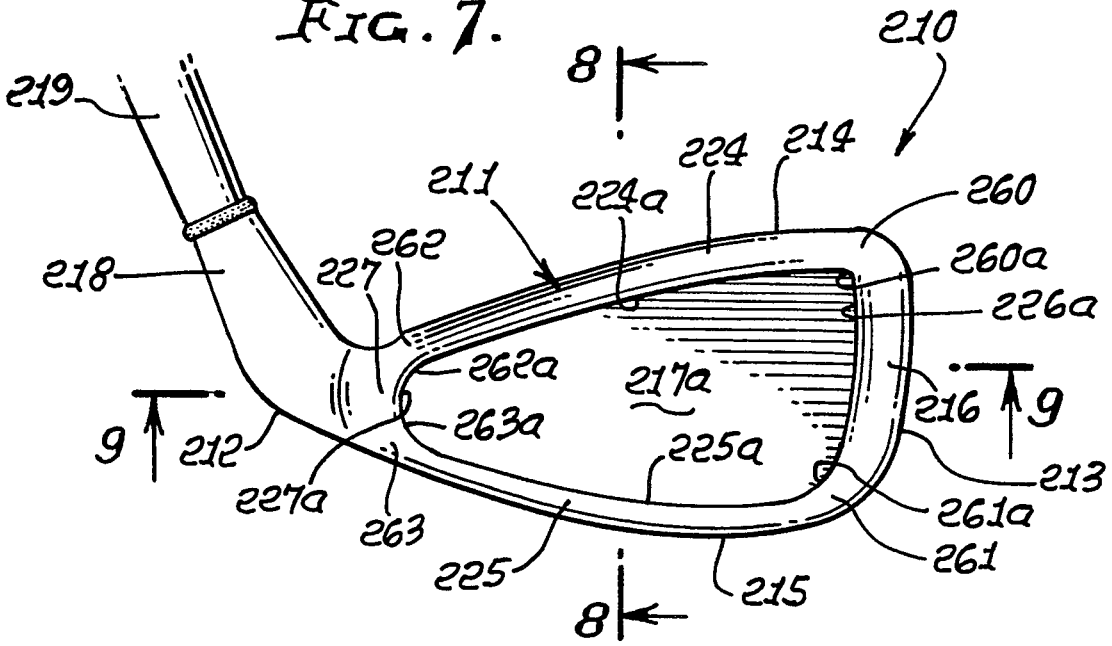
FIG. 7 is a view like FIG. 1 showing a #8 iron incorporating the invention.
Figure 8:
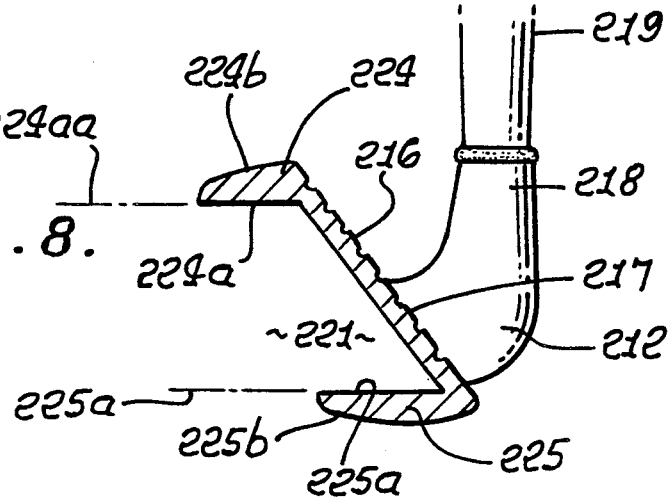
FIG. 8 is a vertical section taken on lines 8—8 of FIG. 7.
Figure 9:
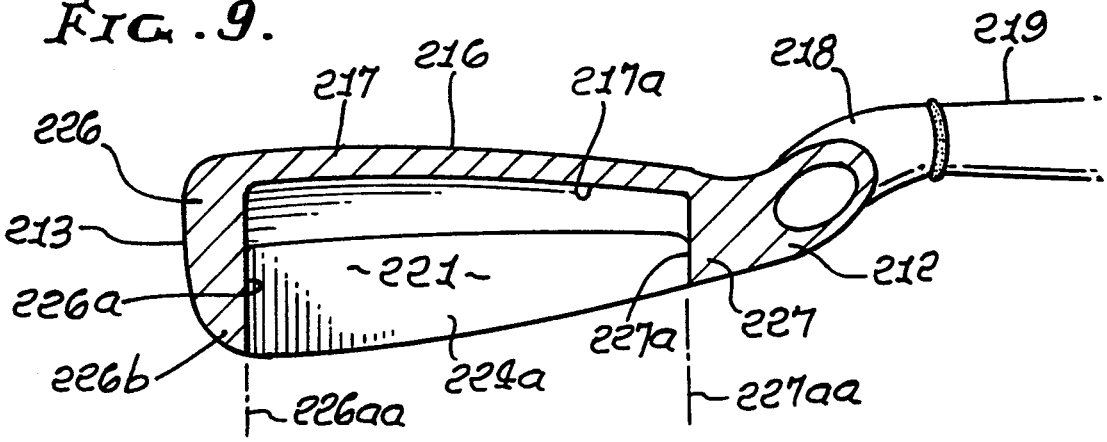
FIG. 9 is a horizontal section taken on lines 9—9 of FIG. 7.

FIGS. 7–9 correspond to FIGS. 1–3, but show a #8 iron with the two recesses in associated structure, as defined above. The corresponding elements have a 2 preceding each number, whereby a two hundred series of elements is defined.

Figure 10:
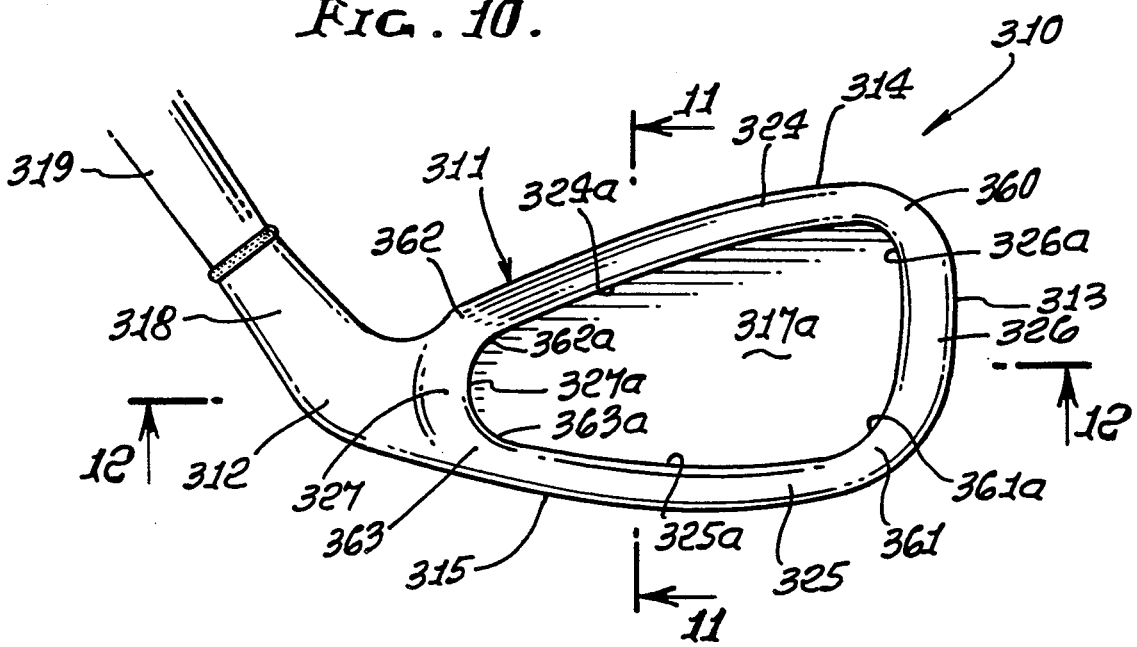
FIG. 10 is a view like FIG. 1 showing a pitching wedge incorporating the invention.
Figure 11:
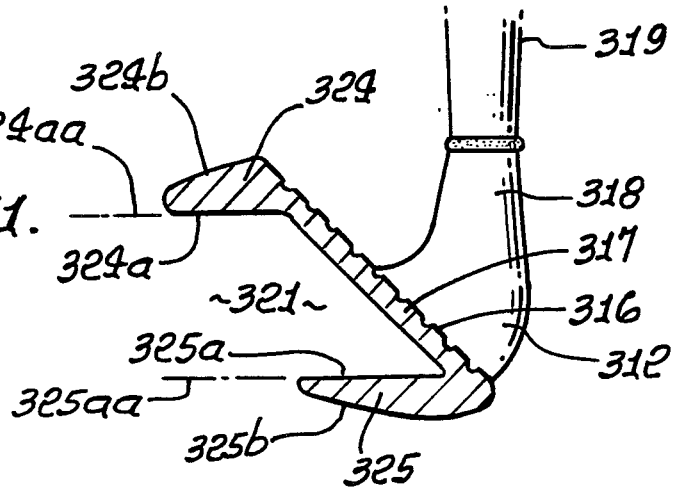
FIG. 11 is a section taken on lines 11—11 of FIG. 10.
Figure 12:
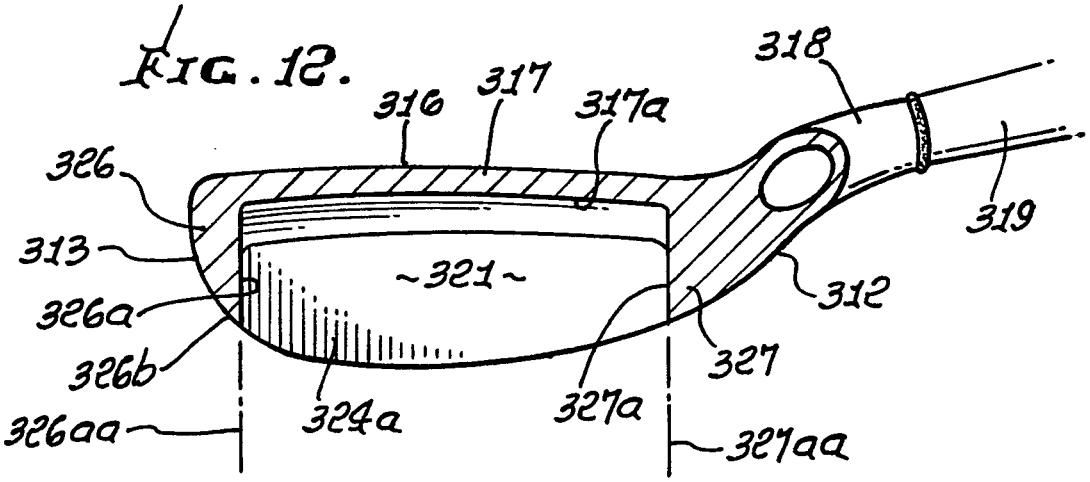
FIG. 12 is a section taken on lines 12—12 of FIG. 10.

FIGS. 10–12 correspond to FIGS. 1–3, but show a pitching wedge with the two recesses in associated structure, as defined above. The corresponding elements have a 3 preceding each number, whereby a three hundred series of elements is defined.

It will be understood that intermediate irons have the same construction, as in FIGS. 15–23, but with associated changing front face inclinations, as in a set of such irons. Accordingly, each iron of the set has the invention incorporated therein. FIGS. 15–23 are vertical sections taken at about the location of section 5—5 of FIG. 4.

All of these features, as described in connection with FIGS. 15–23, contribute to the unusual advantages of the invention, as referred to herein.

Figure 15:
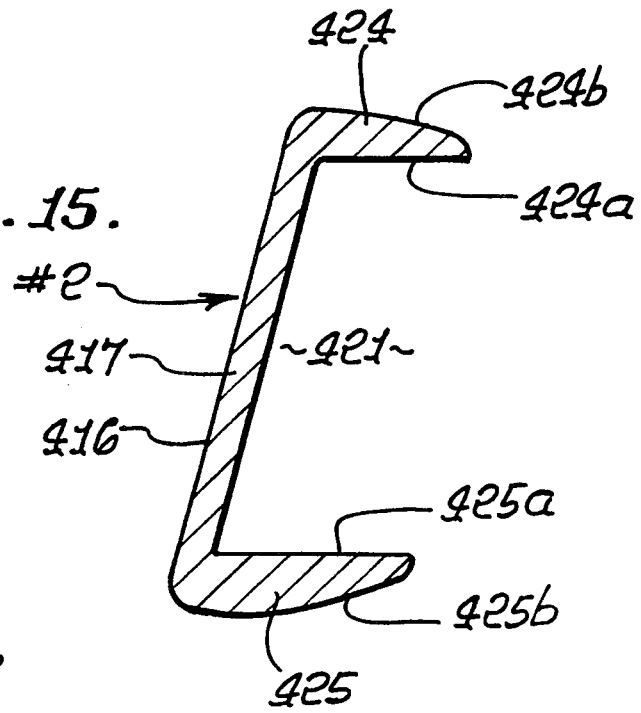
Figure 16:
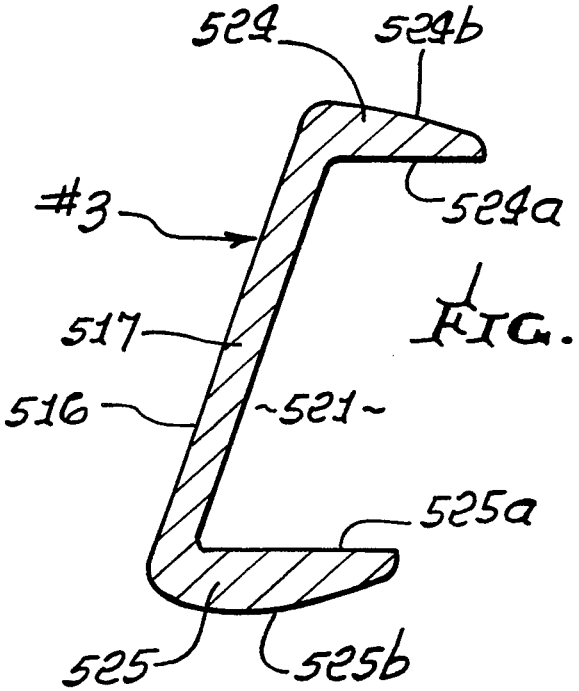
Figure 17:
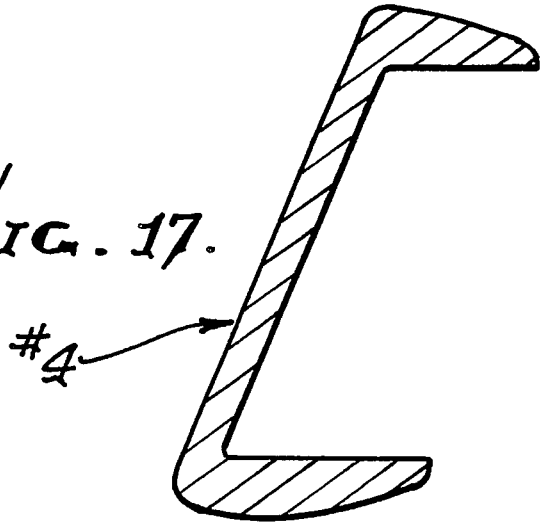
Figure 18:
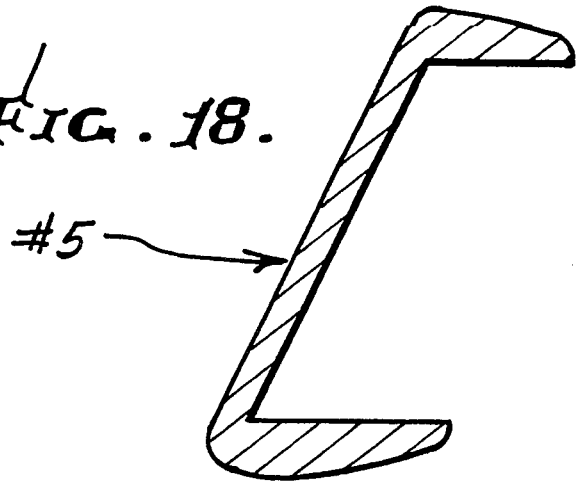
Figure 19:
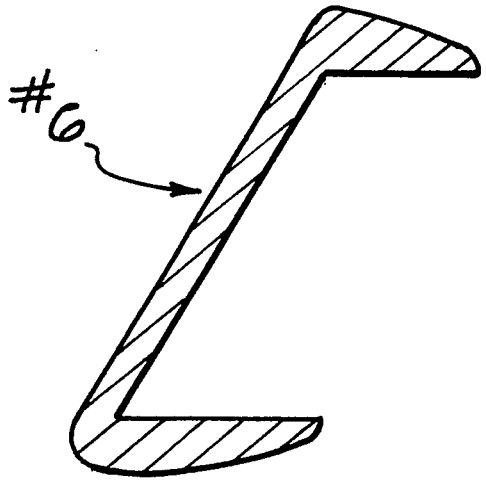
Figure 20:
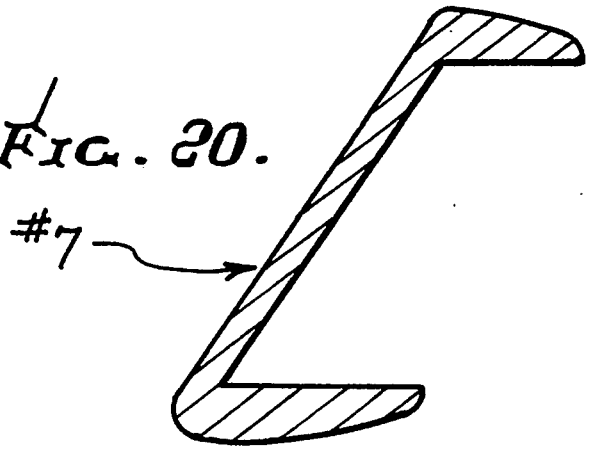

In FIG. 16, corresponding elements are the same as in FIG. 15, but commence with the number 5. See also the remaining views, FIGS. 17–23.

We claim:

1. A golf club head having a body defining a heel, toe, top wall, sole, and a front wall defining an upwardly and rearwardly inclined front face in ball-addressing position of the head, and comprising a) said body defining a forwardly extending main recess located rearwardly of said front wall.

b) and said body having upper and lower projections extending rearwardly from said front wall above and below said main recess, said projections being rearwardly elongated and said recess being horizontally elongated in said ball-addressing position of the head, c) said upper projection having a lowermost surface and said lower projection having an uppermost surface, vertical planes normal to said front face intersecting said surfaces to define lines that extend horizontally rearwardly in said ball-addressing position, said lines throughout their lengths extending in parallel relation, d) each of said upper and lower projections having an overall rearward length dimension and a thickness dimension outwardly from said recess, said length dimension substantially exceeding said thickness dimension.

2. The club head of claim 1 wherein said lower surface is upwardly concave along its length in a direction between the heel and toe.

3. The golf club head of claim 1 wherein said body has a third rearward projection at said toe and which is rearwardly elongated adjacent said rearwardly horizontally elongated recess.

4. The golf club head of claim 3 wherein said third projection has an inner surface characterized in that horizontal planes intersect said inner surface to define lines that extend horizontally rearwardly in said ball-addressing position.

5. The golf club head of claim 3 wherein each of said upper, lower and third projections taper rearwardly.

6. The golf club head of claim 3 wherein said third projection arcuately merges with each of said upper and lower projections to define two arcuate and rearwardly extending corner projections, each of which has an inner corner surface facing said recess, said inner corner surface projecting horizontally rearwardly in said ball-addressing position.

7. The golf club head of claim 6 wherein said body has at least one slit extending rearwardly in at least one of said projections and outwardly from said main recess.

8. The golf club head of claim 7 wherein there are multiple of said slits in multiple of said rearward projections.

9. The golf club head of claim 6 wherein said body has four of said slits located outwardly from said main recess as follows:

proximate the junction of the heel and top wall
proximate the junction of the heel and bottom wall
proximate the junction of the toe and top wall
proximate the junction of the toe and bottom wall.

10. The golf club head of claim 3 wherein said body has a fourth rearwardly projecting surface adjacent said recess and being closer to the heel than said upper, lower and third surfaces, horizontal planes intersecting said third and fourth surfaces defining lines that extend horizontally rearwardly in said ball-addressing position.

11. The golf club head of claim 1 wherein at least one of said upper and lower projections tapers rearwardly.

12. The golf club head of claim 1 wherein both of said upper and lower projections taper rearwardly.

13. The golf club head of claim 1 wherein said body is metallic.

14. The golf club head of claim 13 wherein said body is a one-piece casting, and defines an iron golf club head.

15. The golf club of claim 1 wherein said body consists of a metallic casting.

16. Multiple golf clubs in a set, each head having a configuration as defined in claim 1, the inclined front faces of the heads in the set having increasing rearward angularity.

17. Multiple golf clubs in a set, each head having a configuration as defined in claim 1, the inclined front faces of the heads in the set having increasing rearward angularity.

18. Multiple golf club heads in a set, each head having a body as defined in claim 1.

* * * * *